US011051111B2

(12) United States Patent
Heidinger et al.

(10) Patent No.: US 11,051,111 B2
(45) Date of Patent: Jun. 29, 2021

(54) COIL EXTENSION ELEMENT

(71) Applicant: Sound Solutions International Co., Ltd., Beijing (CN)

(72) Inventors: Franz Heidinger, Unterwaltersdorf (AT); Erich Klein, Himberg (AT); Ernst Tomas, Strasshof an der Nordbahn (AT)

(73) Assignee: Sound Solutions International Co., Ltd., Beijing (CN)

( * ) Notice: Subject to any disclaimer, the term of this patent is extended or adjusted under 35 U.S.C. 154(b) by 0 days.

(21) Appl. No.: 16/059,461

(22) Filed: Aug. 9, 2018

(65) Prior Publication Data

US 2019/0052972 A1 Feb. 14, 2019

(30) Foreign Application Priority Data

Aug. 11, 2017 (AT) ..... A 50670/2017

(51) Int. Cl.
*H04R 9/06* (2006.01)
*H04R 7/04* (2006.01)
(Continued)

(52) U.S. Cl.
CPC ..... *H04R 9/06* (2013.01); *H04R 7/04* (2013.01); *H04R 7/18* (2013.01); *H04R 9/046* (2013.01);
(Continued)

(58) Field of Classification Search
CPC ..... H04R 9/025; H04R 9/06; H04R 9/046; H04R 2209/041; H04R 9/04; H04R 9/043; H04R 9/045; H04R 31/006
(Continued)

(56) References Cited

U.S. PATENT DOCUMENTS

2004/0188175 A1* 9/2004 Sahyoun ..... H04R 7/122 181/157
2006/0088184 A1* 4/2006 Ohashi ..... H04R 7/16 381/430
(Continued)

FOREIGN PATENT DOCUMENTS

CN 2530416 Y 1/2003
CN 201533400 U 7/2010
(Continued)

OTHER PUBLICATIONS

Office Action dated Aug. 11, 2017 for counterpart Austrian Patent Application A50670/2017.
(Continued)

*Primary Examiner* — Alexander Krzystan
(74) *Attorney, Agent, or Firm* — Dykema Gossett PLLC

(57) ABSTRACT

A dynamic loudspeaker driver comprising a magnet-system; a membrane; the membrane being movably mounted with respect to the magnet-system; at least one voice coil attached to the membrane and operatively coupled with the magnet-system, wherein the voice coil comprises an upper edge facing the membrane and a lower edge being arranged opposite the upper edge of the voice coil; at least one voice coil extension element comprising an upper surface facing the membrane and a lower surface facing the upper edge of the voice coil, wherein the lower surface of the voice coil extension element is attached the upper edge of the voice coil while the upper surface of the voice coil extension element is attached to the membrane.

9 Claims, 2 Drawing Sheets

(51) Int. Cl.

| | |
|---|---|
| ***H04R 7/18*** | (2006.01) |
| ***H04R 9/04*** | (2006.01) |
| *H04R 9/02* | (2006.01) |
| *H04R 31/00* | (2006.01) |

(52) U.S. Cl.
CPC ..... *H04R 9/025* (2013.01); *H04R 31/003* (2013.01); *H04R 2307/00* (2013.01)

(58) Field of Classification Search
USPC ..... 381/407, 401, 405
See application file for complete search history.

(56) References Cited

U.S. PATENT DOCUMENTS

| | | | | |
|---|---|---|---|---|
| 2009/0169049 | A1* | 7/2009 | Sun | H04R 7/06 381/423 |
| 2015/0016658 | A1* | 1/2015 | Lee | H04R 9/045 381/412 |
| 2015/0071482 | A1* | 3/2015 | Burleson | H04R 9/04 381/398 |
| 2016/0007121 | A1* | 1/2016 | Hung | H04R 9/046 381/401 |

FOREIGN PATENT DOCUMENTS

| | | | | |
|---|---|---|---|---|
| CN | 104301845 | A | 1/2015 | |
| DE | 1948035 | U | 10/1966 | |
| DE | 3707620 | A1 | 10/1987 | |
| EP | 1113704 | A2 | 4/2001 | |
| EP | 1113704 | A2 * | 7/2001 | H04R 7/00 |
| EP | 1646264 | A2 | 4/2012 | |

OTHER PUBLICATIONS

Office Action in counterpart Chinese Appl. No. 201810909061.8, dated Mar. 16, 2020, with machine language english translation.
Search Report in counterpart Chinese Appl. No. 201810909061.8, dated Mar. 16, 2020, with machine language english translation.
China National Intellectual Property Administration; Office Action issued in counterpart Chinese patent application No. 201810909061.8. Dated Oct. 16, 2020.
China National Intellectual Property Administration; 3rd Office Action issued in counterpart Chinese patent application No. 201810909061.8. dated Apr. 20, 2021.

* cited by examiner

COIL EXTENSION ELEMENT

PRIORITY

This patent application claims priority from Austrian Patent Application No. A50670/2017, filed on Aug. 11, 2017, the disclosure of which is incorporated herein, in its entirety, by reference.

BACKGROUND OF THE INVENTION a. Field of the Invention

The present invention relates to a dynamic loudspeaker driver with enhanced acoustic properties. This invention furthermore relates to a loudspeaker and to a micro speaker optimized for high acoustic output and located within a small volume of a mobile device, such as a mobile phone, a tablet, a gaming device, a notebook or similar device. The invention also relates to a method of producing a loudspeaker driver with enhanced acoustic properties.

b. Background Art

A dynamic loudspeaker driver usually comprises a magnet system, a membrane movably mounted with respect to the magnet system, and a voice coil attached to the membrane. The magnet system comprises a magnet and the voice coil is operatively coupled with the magnet. Usually, a loudspeaker comprises an enclosure and at least one dynamic loudspeaker driver mounted in the enclosure.

When operating, an electric signal is applied to the voice coil, for instance, by an amplifier. Then, the membrane moves with respect to the magnet system and with respect to the enclosure in response to the electric signal, resulting in moving air. A sound-pressure level of the loudspeaker depends on the air moved by the membrane.

When moving, the membrane is subjected to air pressure of the ambient air and the air within the enclosure, forming a load for the moving membrane.

Usually the voice coil is glued directly to the membrane of the loudspeaker. For achieving enough bonding force between coil and membrane a certain amount of glue overflow is necessary. This glue overflow reduces the available space for excursion of the voice coil. This reduces either sensitivity or air pumping capacity of the membrane.

A particular drawback of known loudspeakers is that common voice coils need to have windings far away from the maximum magnetic field to allow the necessary excursion. This reduces sensitivity of the loudspeaker and increases undesired Total Harmonic Distortion (THD).

SUMMARY OF THE INVENTION

It is an object of the present invention to provide a loudspeaker with increased acoustic performance and to reduce Total Harmonic Distortion (THD) of the loud speaker.

It is a further object of the present invention to provide a method for producing a loudspeaker with reduced THD.

The above objects are achieved by means of a dynamic loudspeaker driver, in particular a loudspeaker driver for a loudspeaker of mobile devices such as mobile phones, tablets, gaming devices, notebooks or similar devices, comprising a magnet-system a membrane; the membrane being movably mounted with respect to the magnet-system; at least one voice coil attached to the membrane and operatively coupled with the magnet-system, wherein the voice coil comprises a first edge facing the membrane and a second edge being arranged opposite the first edge of the voice coil; at least one voice coil extension element comprising a first contact surface facing the first edge of the voice coil and a second contact surface facing the membrane, wherein the first contact surface of the voice coil extension element is attached to the first edge of the voice coil whereas the second contact surface of the voice coil extension element is attached to the membrane.

The invention renders it possible that the voice coil comprises windings only in an area of maximum magnetic field intensity without reducing the overall height of the voice coil that is required for installation.

According to an embodiment a shortest distance between the first contact surface of the voice coil extension element and the second contact surface of the voice coil extension element can be 5-50% of a shortest distance between the first edge of the voice coil and the second edge of the voice coil.

Preferably the shortest distance between the first contact surface of the voice coil extension element and the second contact surface of the voice coil extension element is 20 μm-0.5 mm.

In an embodiment the voice coil extension element may have a mass per unit area equal to or less than 2.9 g/m$^2$.

Preferably the voice coil extension element falls in line with an outer contour of the voice coil.

The material of the voice coil extension element can be a synthetic material, which synthetic material is preferably selected from the group of thermoplastics, semi-crystalline thermoplastics, polyethylene naphthalate (PEN), polyether ether ketone (PEEK), Polyethylene terephthalate (PET).

The objects mentioned above are also achieved by means of a method comprising the steps of:

i) providing a voice coil comprising a first edge and a second edge, wherein the second edge is arranged opposite the first edge;

ii) attaching at least one voice coil extension element to the voice coil, wherein the voice coil extension element comprises a first contact surface and a second contact surface, wherein the first contact surface faces in an opposite direction than the second surface; wherein the first contact surface of the at least one voice coil extension element is attached to the first edge of the voice coil;

iii) providing a membrane;

iv) attaching the second surface of the at least one voice coil extension element to the membrane.

According to an embodiment the voice coil extension element used in step ii) is part of a foil or plate, wherein the foil or plate has a first surface directed in a first direction and a second surface directed in a second direction, said first direction being opposite to said second direction, wherein the first contact surface of the voice coil extension element lies within the first surface of the foil or plate, wherein an area of the first surface of the foil or plate corresponding to the first contact surface of the voice coil extension element is attached to the first edge of the voice coil, wherein the voice coil extension element is cut out of the foil or plate after attaching the foil or plate to the first edge of the voice coil and before step iv) is performed.

The voice coil extension element may be cut out of the foil or plate by means of a method selected from the group of laser cutting, ultrasonic cutting, water jet cutting and die cutting.

According to an embodiment the first contact surface of the voice coil extension element is attached to the first edge of the voice coil by means of gluing and/or welding, wherein the second contact surface of the voice coil extension element is attached to the membrane by means of gluing and/or welding. Preferably, the voice coil extension element is attached to the membrane by means of laser welding.

DETAILED DESCRIPTION OF EMBODIMENTS

Figure 1:
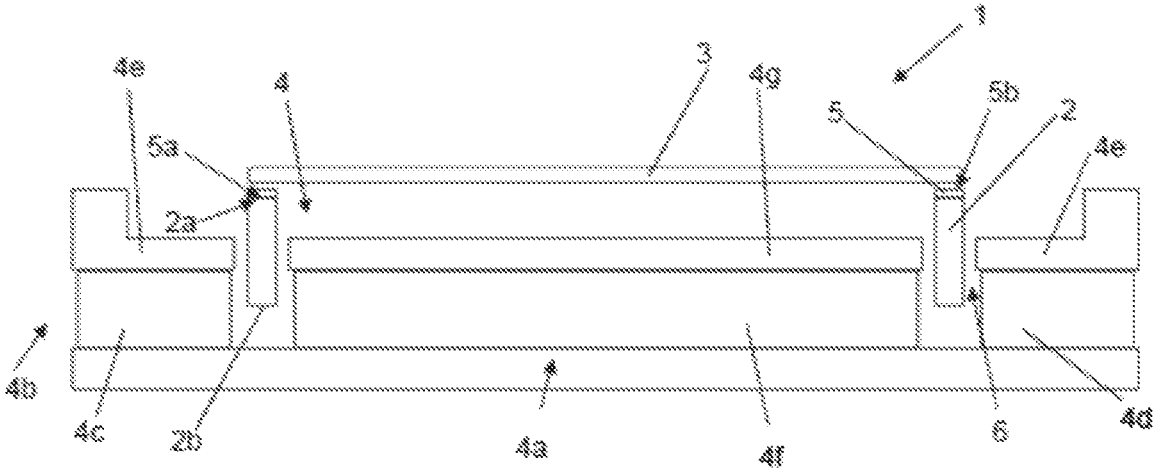
FIG. 1 shows a schematic illustration of an embodiment of a layout of a loudspeaker driver.

FIG. 1 shows a schematic representation of an embodiment of a loudspeaker driver 1. Loud speaker driver 1 comprises a voice coil 2. An electrical signal to drive the voice coil 2 is fed into the voice coil 2 through leads which are nit shown. The voice coil 2 of assembled loudspeaker driver 1 is attached to a membrane 3. A thickness of the membrane 3 can be constant over its entire surface. The membrane 3 is typically built out of one or more layers of material, such as, for example, Ethere Ketone (PEEK), Acrylate and/or Thermoplastic Elastomeric (TPE), Polyetherimide (PEI), and/or other materials known in the art.

Loudspeaker driver 1 includes a magnet system 4 which may comprise a perimeter magnet assembly 4*a* and a center magnet assembly 4*b*. Perimeter magnet assembly 4*a* may include magnets 4*c*, 4*d* arranged on sides of the loudspeaker driver 1 which may be of rectangular shape and a ring plate 4*e* fixed to magnets 4*c*, 4*d*. Center magnet assembly 4*a* includes a magnet 4*f* arranged in the center of the loudspeaker driver 1 and a top plate 4*g* fixed to the magnet 4*f*. Perimeter magnet assembly 4*a*, center magnet assembly 4*b*, and pot plate 4*g* affixed to perimeter and center magnet assemblies 4*a*, 4*b* opposite ring and top plates 4*e*, 4*g* form a magnetic field guide. The magnetic field guide guides and focuses the magnetic field of magnets 4*c*, 4*d* and 4*f* in an air gap 6 between perimeter magnet assembly 4*a* and center magnet assembly 4*b*, into which the voice coil 2 is arranged in the assembled loudspeaker driver 1. It should be mentioned that according to another embodiment the magnet system 4 could also be a single magnet system comprising only the center magnet 4*f*.

The voice coil 1 fits into air gap 7 and is able to translate up and down within air gap 6 according to the electrical signal fed into the voice coil 1 through the leads.

The loudspeaker driver further includes a frame which is not shown to assemble and align the membrane 3 with the magnet system 4. The frame typically is made from a molded plastic which enables the frame to have a complex surface with openings which permit airflow and fixation of other parts of the loudspeaker driver 1. Instead of plastic the frame could also be made of metal. Furthermore, it should be mentioned that the micro-speaker could be a "frameless speaker" as well, wherein the frame is replaced with a collar preferably made of metal. Said collar could be directly mounted to the pot plate 4*g* and/or to the ring plate 4*e*.

The voice coil 2 comprises a first edge 2*a* facing the membrane 3 and a second edge 2*b* being arranged opposite the first edge 2*a* of the voice coil 2. A voice coil extension element 5 is attached to the voice coil 2. The voice coil extension element 5 comprises a first contact surface 5*a* facing the first edge 2*a* of the voice coil 2 and a second contact surface 5*b* facing the membrane 3. The first contact surface 5*a* of the voice coil extension element 5 is attached to the first edge 2*a* of the voice coil 2 whereas the second contact surface 5*b* of the voice coil extension element 5 is attached to the membrane 3. The voice coil extension element 5 may have the shape of a cylindrically, closed ring running around the edge 2*a*. Alternatively the voice coil element 5 may have a jagged or saw-tooth form. Also several voice coil elements 5 may be arranged to around the edge 2*a*. In the latter case the voice coil elements 5 may have the form of pillars being spaced apart form each other and supporting the membrane 3.

Preferably, the voice coil extension element 5 falls in line with an outer contour of the voice coil 2.

The voice coil extension element 5 can be made of an electrically non-conductive material or an electrically conductive material. A non-conductive material is a material having an electrical conductivity less than $10^{-8}$ S/cm.

Preferably, a shortest distance between the first contact surface 5*a* of the voice coil extension element 5 and the second contact surface 5*b* of the voice coil extension element 5 is 5-50% of a shortest distance between the first edge 2*a* of the voice coil 2 and the second edge 2*b* of the voice coil 2. In other words the thickness of the voice coil extension element 5 is 5-50% of the height of the voice coil 2. The shortest distance between the first contact surface 5*a* of the voice coil extension element 5 and the second contact surface 5*b* of the voice coil extension element 5 can be 20 μm-0.5 mm.

To prevent undue damping of the translational movement of voice coil 2 within the air gap 6, the voice coil extension element 5 can have a mass per area equal to or less than 2.9 $g/m^2$.

Although any suitable material can be used for producing the voice coil extension element 5 the material of the voice coil extension element 5 is preferably a synthetic material. The synthetic material can for instance be selected from the group of thermoplastics, semi-crystalline thermoplastics, polyethylene naphthalate (PEN), polyether ether ketone (PEEK), Polyethylene terephthalate (PET). Alternatively, the voice coil extension element could be made of metal, e.g. aluminum, magnesium, etc. as well.

The loudspeaker driver 1 may be produced by means of a method comprising the steps of:

i) providing the voice coil 2;

ii) attaching the first contact surface 5*a* of the voice coil extension element 5 to the first edge 2*a* of the voice coil 2;

iii) providing the membrane 3;

iv) attaching the second surface 5*b* of the voice coil extension element 5 to the membrane 3.

The first contact surface 5*a* of the voice coil extension element 5 can be glued to the first edge 2*a* of the voice coil 2. Preferably, a UV-curable glue 8 is used. In case a UV-curable glue is used the material of the voice coil extension element 5 is translucent for UV-rays. Alternatively, the voice coil extension element can be attached to the voice coil 2 by means of welding as well.

Figure 2:
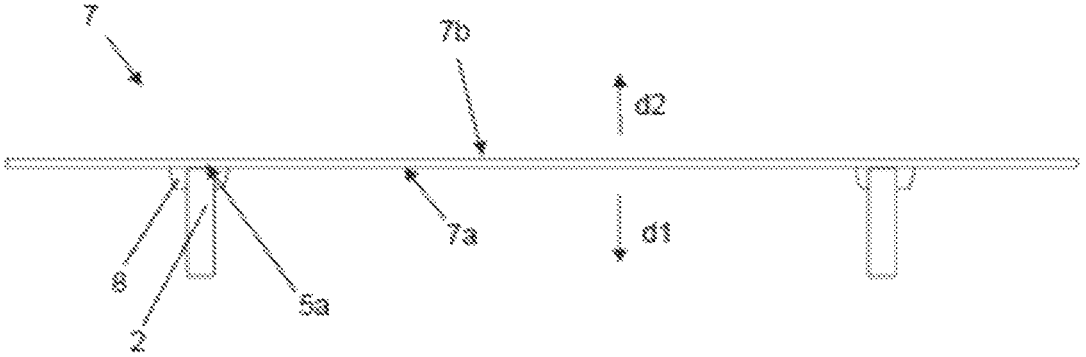
FIG. 2 shows a schematic illustration of the voice coil of the loudspeaker driver of FIG. 1 in a semi-finished state.

According to FIG. 2 the voice coil extension element 5 used in step ii) can be part of a foil 7 or plate. The foil 7 or plate has a first surface 7*a* directed in a first direction d1 and a second surface 7*b* directed in a second direction d2. The first direction d1 being opposite to the second direction d2. The first contact surface 5*a* of the voice coil extension element 5 lies within the first surface 7*a* of the foil 7 or plate. An area of the first surface 7*a* of the foil 7 or plate corresponding to the first contact surface 5*a* of the voice coil extension element 5 is attached to the first edge 2*a* of the voice coil 2. After attaching the foil 7 or plate to the first edge 2*a* of the voice coil 2 and before attaching the voice coil element 5 to membrane 3 the voice coil extension element 5 is cut out of the foil 7 or plate. The voice coil extension element 5 may be cut out of the foil 7 or plate by means of a method selected from the group of laser cutting, ultrasonic cutting, water jet cutting and die cutting.

Figure 3:
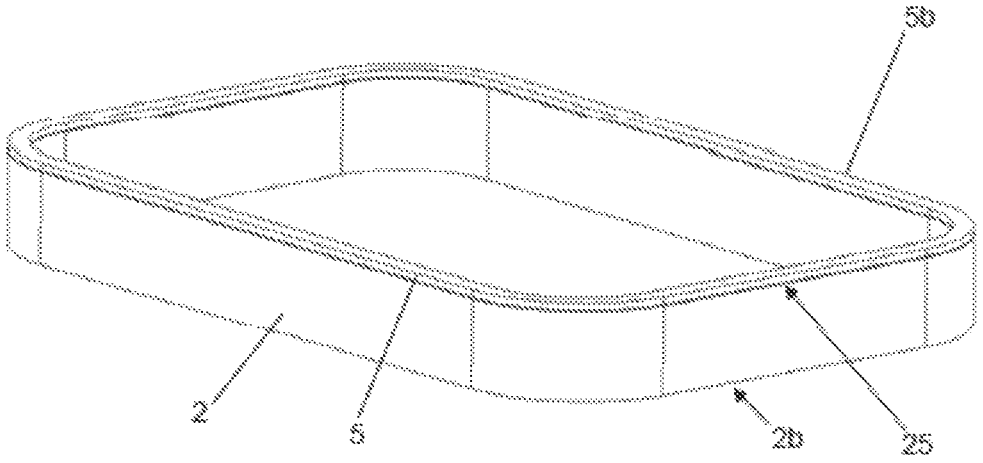
FIG. 3 shows a schematic illustration of the voice coil of FIG. 2 with a voice coil extension element attached thereto.

The resulting structure comprising the voice coil 2 and the voice coil extension element 5 is shown in FIG. 3. The second contact surface 5*b* of the voice coil extension element 5 is attached to the membrane 3 by means of gluing and/or welding, preferably by means of laser welding.

While various steps are described herein in one order, it will be understood that other embodiments of the method can be carried out in any order and/or without all of the described steps without departing from the scope of the invention.

Reference throughout the specification to "various embodiments," "some embodiments," "one embodiment," or "an embodiment," or the like, means that a particular feature, structure, or characteristic described in connection with the embodiment is included in at least one embodiment. Thus, appearances of the phrases "in various embodiments," "in some embodiments," "in one embodiment," or "in an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features, structures, or characteristics of one or more other embodiments without limitation given that such combination is not illogical or non-functional.

It must be noted that, as used in this specification and the appended claims, the singular forms "a," "an" and "the" include plural referents unless the content clearly dictates otherwise.

The terms "first," "second," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Furthermore, the terms "include," "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

All directional references (e.g., "plus," "minus," "upper," "lower," "upward," "downward," "left," "right," "leftward," "rightward," "front," "rear," "top," "bottom," "over," "under," "above," "below," "vertical," "horizontal," "clockwise," and "counterclockwise") are only used for identification purposes to aid the reader's understanding of the present disclosure, and do not create limitations, particularly as to the position, orientation, or use of the any aspect of the disclosure. It is to be understood that the terms so used are interchangeable under appropriate circumstances such that the embodiments of the invention described herein are, for example, capable of operation in other orientations than those illustrated or otherwise described herein.

As used herein, the phrased "configured to," "configured for," and similar phrases indicate that the subject device, apparatus, or system is designed and/or constructed (e.g., through appropriate hardware, software, and/or components) to fulfill one or more specific object purposes, not that the subject device, apparatus, or system is merely capable of performing the object purpose.

Joinder references (e.g., "attached," "coupled," "connected," and the like) are to be construed broadly and may include intermediate members between a connection of elements and relative movement between elements. As such, joinder references do not necessarily infer that two elements are directly connected and in fixed relation to each other. It is intended that all matter contained in the above description or shown in the accompanying drawings shall be interpreted as illustrative only and not limiting. Changes in detail or structure may be made without departing from the spirit of the invention as defined in the appended claims.

All numbers expressing measurements and so forth used in the specification and claims are to be understood as being modified in all instances by the term "about."

What is claimed is:

1. A dynamic loudspeaker driver comprising:

a magnet-system;

a membrane; the membrane being movably mounted with respect to the magnet-system;

at least one voice coil attached to the membrane and operatively coupled with the magnet-system, wherein the voice coil comprises a first edge facing the membrane and a second edge being arranged opposite the first edge of the voice coil; and at least one non-conductive voice coil extension element comprising a first contact surface facing the first edge of the voice coil and a second contact surface facing the membrane, wherein the first contact surface of the voice coil extension element is directly attached to the first edge of the voice coil whereas the second contact surface of the voice coil extension element is attached to the membrane, wherein the first contact surface at which the at least one voice coil extension element contacts with the first edge of the voice coil and the second contact surface at which the at least one voice coil extension element contacts with the membrane have substantially the same shape and area, wherein the membrane is flat between the connections with the voice coil extension element.

2. The loudspeaker driver of claim 1, wherein a shortest distance between the first contact surface of the voice coil extension element and the second contact surface of the voice coil extension element is 5-50% of a shortest distance between the first edge of the voice coil and the second edge of the voice coil.

3. The loudspeaker driver of claim 1, wherein the shortest distance between the first contact surface of the voice coil extension element and the second contact surface of the voice coil extension element is 20 μm-0.5 mm.

4. The loudspeaker driver of claim 1, wherein the voice coil extension element has a mass per volume equal to or less than 2.9 g/cm3.

5. The loudspeaker driver of claims 1, wherein the voice coil extension element falls in line with an outer contour of the voice coil.

6. The loudspeaker of claim 1, wherein the material of the voice coil extension element is a synthetic material, which synthetic material is selected from the group of thermoplastics, semi-crystalline thermoplastics, polyethylene naphthalate (PEN), polyether ether ketone (PEEK), Polyethylene terephthalate (PET).

7. The loudspeaker driver of claim 2, wherein the shortest distance between the first contact surface of the voice coil extension element and the second contact surface of the voice coil extension element is 20 μm-0.5 mm.

8. The loudspeaker driver of claim 1, wherein the at least one voice coil extension element has a shape of a cylindrically, closed ring running around the first edge of the voice coil.

9. A dynamic loudspeaker driver comprising:

a magnet-system;

a membrane, the membrane being movably mounted with respect to the magnet-system;

at least one voice coil operatively coupled with the magnet-system, the voice coil comprising a first edge and a second edge, the second edge being axially opposite the first edge along the axis of movement of the voice coil; and at least one voice coil extension element attached to the membrane and to the voice coil, the voice coil extension element comprising a first contact surface and a second contact surface opposite the first contact surface, the first contact surface and the second contact surface having substantially the same shape and area, and wherein the first contact surface of the voice coil extension element is directly attached to the first edge of the voice coil and the second contact surface of the voice coil extension element is directly attached to the membrane, and wherein the membrane is flat between the connection to the voice coil extension element.

* * * * *